US008254607B2

(12) United States Patent
Ritter et al.

(10) Patent No.: US 8,254,607 B2
(45) Date of Patent: Aug. 28, 2012

(54) HEARING AID WITH ACOUSTIC DAMPER

(75) Inventors: Hartmut Ritter, Neunkirchen am Brand (DE); Tom Weidner, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 642 days.

(21) Appl. No.: 12/322,622

(22) Filed: Feb. 5, 2009

(65) Prior Publication Data

US 2009/0196446 A1 Aug. 6, 2009

(30) Foreign Application Priority Data

Feb. 5, 2008 (DE) ..... 10 2008 007 553

(51) Int. Cl.
*H01R 25/00* (2006.01)

(52) U.S. Cl. ..... 381/322; 361/330

(58) Field of Classification Search ..... 381/322, 381/330

See application file for complete search history.

(56) References Cited

U.S. PATENT DOCUMENTS

| | | | | |
|---|---|---|---|---|
| 4,296,829 | A * | 10/1981 | Pedersen | 181/129 |
| 4,349,082 | A | 9/1982 | Gastmeier | |
| 4,498,555 | A * | 2/1985 | Cerny | 181/129 |
| 4,564,955 | A * | 1/1986 | Birch et al. | 381/330 |
| 4,677,675 | A | 6/1987 | Killion et al. | |
| 5,488,205 | A * | 1/1996 | Major | 181/129 |
| 6,275,596 | B1 | 8/2001 | Fretz et al. | |
| 6,671,381 | B1 | 12/2003 | Lux-Wellenhof | |
| 2003/0072459 | A1 | 4/2003 | Cole et al. | |
| 2004/0099473 | A1 | 5/2004 | Killion | |
| 2004/0240694 | A1 * | 12/2004 | Wolf | 381/322 |
| 2005/0249369 | A1 | 11/2005 | Angst et al. | |
| 2007/0036381 | A1 * | 2/2007 | Klemenz et al. | 381/330 |
| 2008/0085024 | A1 * | 4/2008 | Linkenkaer-Hansen et al. | 381/330 |

FOREIGN PATENT DOCUMENTS

| | | | |
|---|---|---|---|
| DE | 29815171 | U1 | 2/1999 |
| DE | 20114523 | U1 | 12/2001 |
| EP | 1316239 | A2 | 6/2003 |
| EP | 1458217 | A2 | 9/2004 |
| WO | 9515067 | A1 | 6/1995 |
| WO | 03027480 | A1 | 4/2003 |

OTHER PUBLICATIONS

Communication From European Patent Office, Mar. 22, 2012, pp. 1-15.

* cited by examiner

*Primary Examiner* — Jasmine Clark

(57) ABSTRACT

A hearing aid is provided. The hearing aid has a one- or multi-part carrying hook. The one- or multi-part carrying hook has a tip for connection to a sound tube, the tip being connected integrally to a damper extending across the internal cross-section of the tip, the damper preferably being designed as a membrane.

14 Claims, 2 Drawing Sheets

HEARING AID WITH ACOUSTIC DAMPER

CROSS REFERENCE TO RELATED APPLICATIONS

This application claims priority of German application No. 10 2008 007 553.1 DE filed Feb. 5, 2008, which is incorporated by reference herein in its entirety.

FIELD OF INVENTION

The present invention relates to a hearing aid with acoustic damper in the sound channel in the carrying hook of the hearing aid. In particular the present invention relates to an improved arrangement of the damper in the tip of the carrying hook.

BACKGROUND OF INVENTION

Hearing aids are technical aids which compensate for congenital or acquired losses in auditory function that do not respond to causal treatment. Hearing aids amplify and modulate the sound, in other words the acoustic signal, upstream of the actual sensory organ of the ear, the inner ear. Constructed of a microphone, amplifier, power source and receiver, various types of aid are available.

FIG. 1 shows a diagrammatic illustration of a so-called behind-the-ear (BTE) hearing aid. This concerns a hearing aid 1 which is worn behind the pinna. The amplified sound is routed into the external acoustic meatus via a carrying hook 2 (also called a hook or elbow fitting or angle piece), a sound tube (not shown) and an earpiece (not shown) principally manufactured from transparent plastic. Depending on the configuration the BTE device 1 can have a volume control 4 and a switch 5 for switching on and off as well as for selecting an inductive operating mode.

The carrying hook 2 has a sound channel 3, with which the sound generated by a receiver is routed to the sound tube, which can be pushed over a swelling in the carrying hook 2, said swelling having the shape of a truncated cone.

Such carrying hook/sound tube arrangements are frequently provided with acoustic dampers, in order to achieve improvements in sound, for example by smoothing sound channel resonances and/or achieving a frequency response perceived as pleasant.

Different damper arrangements for hearing aids are known from the prior art. In the example in FIG. 1 a damper 6 is introduced into the end or the tip of the carrying hook 2. FIGS. 2*a* and 2*b* show such a damper. In such an arrangement the diameter of the membrane, which produces the acoustic damping, is generally only 1.4 mm, since the tip of the carrying hook 2 is tailored to the sound tube, which generally has an internal diameter of 2 mm, and since moreover the membrane is held by a metal sleeve, which for its part limits the effective diameter. It would however be desirable for the diameter of the membrane to be as large as possible in order to obtain as large as possible an acoustically effective surface area.

An arrangement is known from DE 201 14 523 U1 in which the damper is introduced into a lateral slit in the carrying hook and is fixed there by the sound tube which is then pushed over it. While such an arrangement does away with the problem addressed above of the diameter being too small, it is expensive in design terms, and if the sound tube is accidentally removed from the carrying hook the damper—as also in the arrangement according to FIG. 1—can easily get lost.

Different filter arrangements are known from U.S. Pat. No. 4,677,675 which are accommodated in the carrying hook 2. While such filters can also serve as dampers, they are however much too expensive for this comparatively easy purpose and require the carrying hook to have a certain volume, which runs counter to the miniaturization being striven for.

SUMMARY OF INVENTION

It is hence the object of the present invention to specify an improved damper arrangement for a hearing aid.

This object is achieved by a hearing aid with a one- or multi-part carrying hook, which has a tip for connection to a sound tube, the tip being connected in integrally formed manner to a damper extending across the internal cross-section of the tip.

In this case the damper is preferably designed as a membrane or grid.

In this case the tip of the carrying hook is preferably manufactured from plastic by means of the injection molding process, the damper being simultaneously injected and overmolded.

In one embodiment the tip of the carrying hook has an internal diameter of 1.8 mm, the diameter of the damper then also being 1.8 mm.

An advantage of the present invention can be seen in that the damper cannot accidentally fall out, since it is permanently connected to the tip of the carrying hook.

A further advantage can be seen in that no additional support elements need be provided for the damper, which on the one hand simplifies the design and thus permits a cheaper device less prone to defects and on the other hand means the entire internal cross-section of the tip can be used as a damping surface.

BRIEF DESCRIPTION OF THE DRAWINGS

In the following, exemplary embodiments of the invention are explained in greater detail on the basis of drawings. These show.

DETAILED DESCRIPTION OF INVENTION

Figure 1:
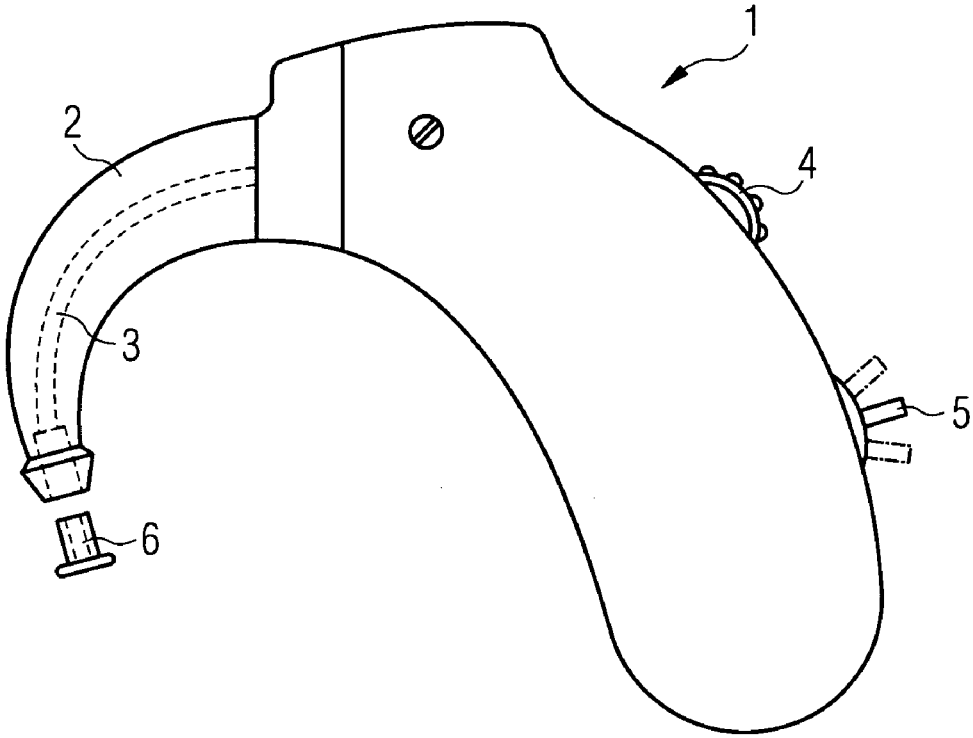
FIG 1 Prior art
FIG. 1 a diagrammatic illustration of a behind-the-ear hearing aid with a damper which can be introduced into the tip of the carrying hook.
Figure 2A:
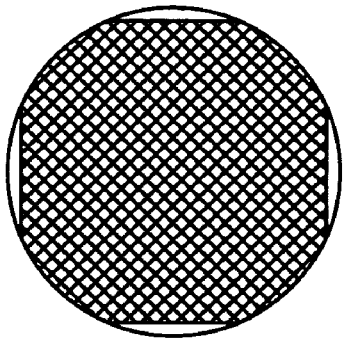
FIG 2A Prior art
FIGS. 2*a* and 2*b* depict a damper, suitable for the arrangement according to FIG. 1.
Figure 2B:
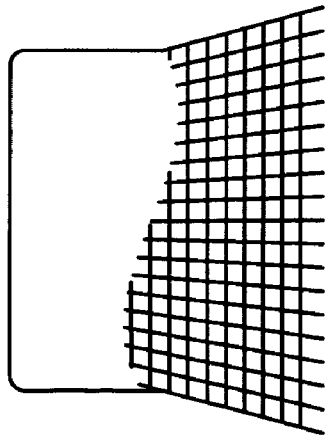
FIG 2B Prior art

FIGS. 1 and 2 show, as already explained in the introduction, an arrangement known from the prior art for a damper in the tip of the carrying hook of a hearing aid, wherein to prevent repetition reference is made to the corresponding passages of the introductory part of the description.

Figure 3A:
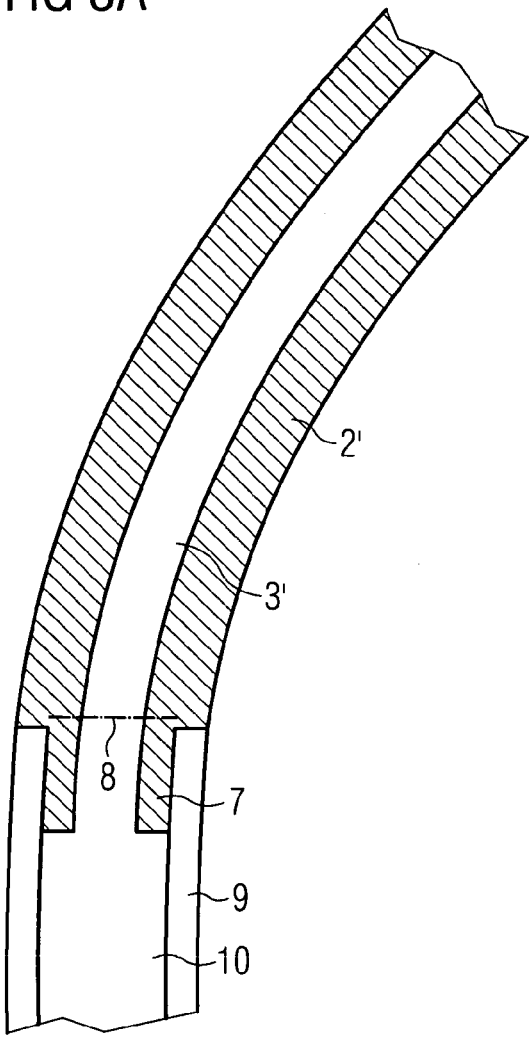
FIG. 3*a* a diagrammatic illustration of a one-part carrying hook of a hearing aid with a damper integrally connected to the tip of the carrying hook.

FIG. 3*a* shows a diagrammatic illustration of a one-part carrying hook 2' of a hearing aid with a damper 8 integrally connected to the tip of the carrying hook 7 according to a first exemplary embodiment of the present invention. The carrying hook 2' has a sound channel 3' which serves to feed the acoustic signals generated by the hearing aid receiver (not shown) into a channel 10 of a sound tube 9, via which the acoustic signals are routed into the acoustic meatus of the hearing aid wearer.

The carrying hook 2' is connected on one side to the hearing aid (not shown) and on the side not connected to the hearing aid has a tip 7 which serves for the mechanical coupling of carrying hook 2' and sound tube 9. The embodiments that come into consideration for the design of the tip 7 are all those which ensure a secure, but detachable, seat for the sound tube 9 on the carrying hook 2', such as an essentially cylindrical connection as shown in FIG. 3*a*, in which the respective diameters and surface roughnesses are selected such that the static friction between sound tube 9 and carrying hook 2' provides a secure connection, or a connection by means of a tip in the shape of a truncated cone as shown in FIG. 1.

A membrane 8, which is preferably used for acoustic damping, but can also have other functions, is integrally connected to the tip 7 of the carrying hook 2'. Preferably the carrying hook 2' is manufactured with the membrane 8 in a single work process by means of plastic injection molding. Advantageously, no additional precautions are then needed to fix the membrane in the carrying hook 2', and the internal cross-section of the tip of the carrying hook is available in full as an acoustically active surface area. In this situation the stability of the carrying hook 2' is not affected.

The damping effect of the membrane 8 is also determined by the number of meshes in the membrane and the acoustic flow, which can be determined from the ratio between acoustically active surface area and the thickness of the membrane fibers.

In the case of a typical carrying hook 2' with a circular cross-section, the entire internal diameter of 1.8 mm, i.e. a surface area of approx. 2.54 $mm^2$, is available for the membrane 8. The membrane diameters in the prior art are in contrast regularly only 1.4 mm, corresponding to a membrane surface area of 1.54 $mm^2$, i.e. the acoustically effective surface area is increased by the invention by 65% compared to the exemplary embodiment in FIG. 1, and simultaneously the structure of the hearing aid is simplified, as it now consists of few individual parts. As a result of the higher acoustically effective surface area partial contaminations of the same size have less impact on the effectiveness of the damping membrane 8. Likewise unavoidable production tolerances in the manufacture of the membranes have less impact in percentage terms, so that the damping values of the manufactured membranes vary less.

Figure 3B:
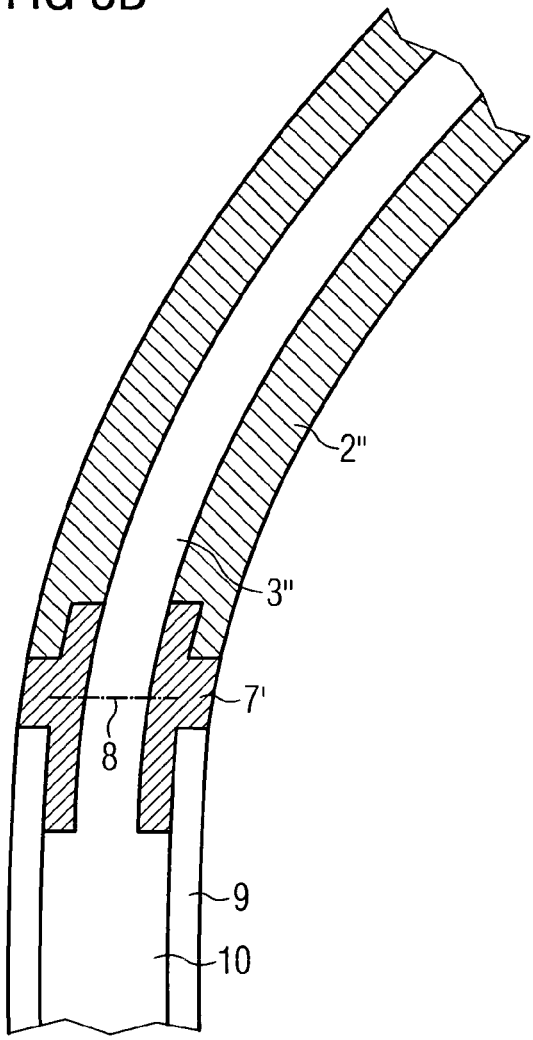
FIG. 3*b* a diagrammatic illustration of a two-part carrying hook of a hearing aid with a damper integrally connected to the tip of the carrying hook.

In a further exemplary embodiment of the present invention, provision is made for manufacturing the carrying hook and the tip of the carrying hook separately. This is shown diagrammatically in FIG. 3*b*. The carrying hook 2" has a tip 7' and these are initially manufactured separately from one another and are not permanently connected to one another until a later stage. The explanations for FIG. 3*a* apply correspondingly in respect of the function of the tip 7'. Once again, a membrane 8, which is preferably used for acoustic damping, but can also have other functions, is integrally connected to the tip 7'. Preferably the tip 7' is manufactured with the membrane 8 in a single work process by means of plastic injection molding.

The advantage of this design compared to that in FIG. 3*a* lies in the fact that different dampers can be manufactured, which are then not permanently connected to the carrying hook 2" as required, such as by adhesion, ultra-sound welding or screwing-in of the tip 7' into the carrying hook 2", until the hearing aid is adjusted to the respective functional hearing loss.

The invention claimed is:

1. A hearing aid, comprising:

a sound tube;

a damper; and a carrying hook, and a tip connected integrally to the damper extending across the internal cross-section of the tip wherein the tip includes an abutment portion located between first and second insertion ends wherein the first insertion end is inserted into the hook and the second insertion end is inserted into the sound tube wherein the hook and sound tube are spaced apart from each other by the abutment portion.

2. The hearing aid as claimed in claim 1, wherein the damper is a membrane or a grid.

3. The hearing aid as claimed in claim 1, wherein the tip is formed from plastic by an injection molding process, and wherein the damper is injected into the tip simultaneously with the forming thereof.

4. The hearing aid as claimed in claim 2, wherein the tip is formed from plastic by an injection molding process, and wherein the damper is injected into the tip simultaneously with the forming thereof.

5. The hearing aid as claimed in claim 1, wherein the tip and the damper are formed from plastic by an injection molding process.

6. The hearing aid as claimed in claim 2, wherein the tip and the damper are formed from plastic by an injection molding process.

7. The hearing aid as claimed in claim 1, wherein an acoustically effective surface area of the damper is equal to an internal cross-sectional surface area of the carrying hook.

8. The hearing aid as claimed in claim 7, wherein the carrying hook has a circular cross-section with an internal diameter of 1.8 mm, which simultaneously corresponds to a diameter of the acoustically effective surface area of the damper.

9. The hearing aid as claimed in claim 2, wherein an acoustically effective surface area of the damper is equal to an internal cross-sectional surface area of the carrying hook.

10. The hearing aid as claimed in claim 9, wherein the carrying hook has a circular cross-section with an internal diameter of 1.8 mm, which simultaneously corresponds to a diameter of the acoustically effective surface area of the damper.

11. The hearing aid as claimed in claim 3, wherein an acoustically effective surface area of the damper is equal to an internal cross-sectional surface area of the carrying hook.

12. The hearing aid as claimed in claim 11, wherein the carrying hook has a circular cross-section with an internal diameter of 1.8 mm, which simultaneously corresponds to a diameter of the acoustically effective surface area of the damper.

13. A hearing aid, comprising:

a sound tube;

a damper that is a membrane or a grid;

a carrying hook; and a tip integrally formed with the damper, wherein the tip includes an abutment portion located between first and second insertion ends wherein the first insertion end is inserted into the hook and the second insertion end is inserted into the sound tube wherein the hook and sound tube are spaced apart from each other by the abutment portion and wherein the damper extends across an internal cross section of the tip;

wherein an acoustically effective surface area of the damper is equal to an internal cross-sectional surface area of the tip of the carrying hook.

14. The hearing aid as claimed in claim 13, wherein the carrying hook has a circular cross-section with an internal diameter of 1.8 mm, which simultaneously corresponds to a diameter of the acoustically effective surface area of the damper.

* * * * *